US006880748B2

(12) United States Patent
Machado et al.

(10) Patent No.: US 6,880,748 B2
(45) Date of Patent: Apr. 19, 2005

(54) SYSTEM AND METHOD FOR PACKAGING OF FRESH PRODUCE INCORPORATING MODIFIED ATMOSPHERE PACKAGING

(76) Inventors: Craig Dale Machado, 840 Via Bandelaro, Arroyo Grande, CA (US) 93420; John Anthony Guido, 2355 Bonnie Jean La., Arroyo Grande, CA (US) 93420

( * ) Notice: Subject to any disclaimer, the term of this patent is extended or adjusted under 35 U.S.C. 154(b) by 0 days.

(21) Appl. No.: 10/397,945

(22) Filed: Mar. 25, 2003

(65) Prior Publication Data

US 2004/0188507 A1 Sep. 30, 2004

(51) Int. Cl.[7] ..... B65D 5/00

(52) U.S. Cl. ..... 229/120; 229/918; 229/162.4; 229/125.015; 206/508

(58) Field of Search ..... 229/120, 125.015, 229/162.4; 206/508

(56) References Cited

U.S. PATENT DOCUMENTS

| | | | | |
|---|---|---|---|---|
| 2,618,937 | A | | 11/1952 | Francis |
| 2,986,320 | A | | 5/1961 | Nicholls et al. |
| 3,199,717 | A | | 8/1965 | Povering |
| 3,211,326 | A | | 10/1965 | Davis |
| 3,297,191 | A | * | 1/1967 | Eastman ..... 220/512 |
| 3,575,311 | A | | 4/1971 | Etienne et al. |
| 3,863,831 | A | | 2/1975 | Wozniacki et al. |
| 3,871,570 | A | | 3/1975 | Garmon |
| 4,039,121 | A | | 8/1977 | Crane |
| 4,101,048 | A | | 7/1978 | Rieben et al. |
| 4,515,266 | A | | 5/1985 | Myers |
| 4,629,084 | A | | 12/1986 | Hackelsberger |
| 4,673,087 | A | * | 6/1987 | Webb ..... 206/600 |
| 5,052,615 | A | | 10/1991 | Ott et al. |
| 5,121,877 | A | | 6/1992 | Bodary et al. |
| 5,390,847 | A | | 2/1995 | Young |
| 5,429,296 | A | | 7/1995 | Southwell et al. |
| 5,516,034 | A | | 5/1996 | Jensen et al. |
| 5,575,418 | A | | 11/1996 | Wu et al. |
| 5,860,590 | A | | 1/1999 | Bloomfield et al. |
| 5,967,406 | A | | 10/1999 | Moorman |
| 6,024,279 | A | * | 2/2000 | McGary et al. ..... 229/199 |
| 6,029,842 | A | | 2/2000 | Sheffler e al. |
| 6,050,412 | A | | 4/2000 | Clough et al. |
| 6,186,354 | B1 | | 2/2001 | Pascal |
| 6,220,507 | B1 | * | 4/2001 | Guillin ..... 229/122.22 |
| 6,286,520 | B1 | | 9/2001 | Lin |
| D458,508 | S | | 6/2002 | Thonis et al. |
| D459,146 | S | | 6/2002 | Klock et al. |
| 2002/0008134 | A1 | | 1/2002 | Southwell |

OTHER PUBLICATIONS

Also cited European Patent application EP 0 282 180 A2 to Greengrass, filed Feb. 17, 1988.

* cited by examiner

*Primary Examiner*—Tri M. Mai
(74) *Attorney, Agent, or Firm*—Gross & Associates

(57) ABSTRACT

A modified atmosphere packaging system and method which allows field and/or centralized facility packing of fresh produce and refrigerated air to circulate throughout a palletized stack of cartons. The packaging includes a transparent lid which is sealingly attached to a corrugated carton allowing for inspection of perishable produce contained therein without breaching an established modified atmosphere.

27 Claims, 5 Drawing Sheets

SYSTEM AND METHOD FOR PACKAGING OF FRESH PRODUCE INCORPORATING MODIFIED ATMOSPHERE PACKAGING

CROSS-REFERENCE TO RELATED APPLICATIONS

Not applicable

FEDERALLY SPONSORED RESEARCH AND DEVELOPMENT

Not applicable.

REFERENCE TO A MICROFICHE APPENDIX

Not applicable.

FIELD OF INVENTION

The present invention relates generally to an article of manufacture for use in the packaging of fresh produce and more specifically to a packaging system and method which incorporates modified atmosphere packaging technology.

BACKGROUND

The fresh produce industry incorporates the use of stackable corrugated fiberboard cartons or returnable plastic crates of various sizes and shapes to accommodate a wide array of fresh fruits and vegetables for transportation to market. In general, there are two broad categories of stackable fiberboard cartons used in the produce industry, open style cartons which incorporate apertures such as hand-holds and concavities for refrigerated air circulation and closed style cartons which do not include the apertures and concavities but does incorporate selective gas permeable membranes to limit gas exchange between the sealed cartons and ambient atmosphere.

The main advantages of the open style cartons allows for direct field packing of the harvested produce in the cartons, followed by refrigeration and shipment to market. The simple packaging and cooling of the produce provides significant time, labor and cost savings. The main disadvantages of this type of packaging is that the free movement of oxygen around the produce reduces the amount of time the produce can be stored and/or transported. To offset some of these deleterious effects, produce is harvested earlier in the growing season, usually before optimal nutritional values and desirable tastes have developed, thus reducing the quality of the produce delivered to market. Another disadvantage of the open style packaging is the minimal protection afforded to temperature excursions occasionally encountered during transportation to market.

The lack of insulating air and packaging materials surrounding the produce allows temperature changes to more rapidly impact the stored produce. For temperature sensitive produce, (e.g., peaches) an extended refrigeration failure could result in the loss of an entire produce shipment. Examples of typical stackable containers include U.S. Pat. No. 5,121,877 to Bodary, et al. which discloses a palletized containers for ripening of fruit during shipment and storage; U.S. Pat. No. 3,871,570 to Garmon which discloses a stackable tray for shipping of fresh fruits and vegetables; U.S. Pat. No. 5,967,406 to Moorman which discloses a stackable Bliss style shipping container which can be reconfigured into a retail, club or wholesale market display container; U.S. Pat. No. 5,052,615 to Ott, et al. which discloses another stackable shipping and display carton; U.S. Pat. No. 4,101,048 to Rieben, et al. which discloses another stackable produce field carton; and U.S. Pat. No. 3,863,831 to Wozniacki, et al. which discloses a stackable shipping carton which allows ventilation and/or cooling of the contents of the carton.

Corrugated cartons which incorporate selective gas permeable membranes are known in the relevant art as modified atmosphere packaging (MAP). Modified atmosphere packaging is available in various shapes and sizes and generally includes lids or flaps that are integral to the carton. The major advantages of using MAP is that produce life is extended beyond non modified atmosphere packaging anywhere from 10 to 25 days depending on the particular produce being packaged and weight loss due to refrigeration is greatly reduced. The extended produce life allows the produce to be harvested closer to maturity thus retaining optimal nutritional values and desirable tastes and facilitates longer transportation durations, a particularly important consideration when fresh fruits and vegetables are being transported from tropical growing regions to markets located around the globe (e.g., bananas).

The product life extension capability of MAP is extremely important in the premium fresh produce industry where considerable cost savings over regular cartons may be obtained where such produce would have to be air shipped rather than using considerably less expensive shipping alternatives such as cargo vessels and/or land transportation. The sealed packaging also affords greater protection from temperature excursions due to the increased insulating properties of the modified atmosphere and enveloping carton surrounding the produce. The are however, several disadvantages to the relevant art modified atmosphere packaging including difficulties in efficiently re-refrigerating palletized or stacked produce during shipment due to the inability to provide adequate refrigerated air circulation around the palletized and/or stacked produce cartons, in particular interior cartons which are insulated from the refrigerated air by the surrounding exterior cartons.

Another disadvantage of the relevant art modified atmosphere packaging is that there is generally no way to visually inspect the produce inside after the cartons have been sealed. Damaged produce, insect pests and other problems may not be discovered until the produce is delivered to its final destination. Examples of packaging incorporating modified atmosphere technologies include U.S. Pat. No. 5,575,418 to Wu, et al. discloses a corrugated paperboard carton which includes a gas permeable membrane incorporated into the package for shipment of fresh produce and cut flowers; European patent application 0 282 180 to Greengrass discloses a container, bag or encasement which incorporates a gas permeable membrane for the delayed ripening of produce enveloped by the permeable membrane. U.S. Pat. No. 4,515,266 to Myers discloses a sealed container filled with a preservative gas for inhibiting bacterial growth; and U.S. Pat. No. 6,050,412 to Clough, et al. discloses a method and apparatus for packaging and shipping cut flowers using a modified atmosphere package.

None of the cited references provides stackable packages which incorporates modified atmosphere technology, allows cooling ventilation of stacked and/or palletized packages and facilitates visual inspection of the package contents without having to open the sealed package.

Therefore, what is needed is a corrugated package which incorporates modified atmosphere technology, allows field harvesting and packaging of produce in either the field or in a centralized facility, allows cooling ventilation of stacked and/or palletized packages directly in the modified atmosphere packaging, allows visual inspection of the packaged produce at any point following packaging and provides the ability to re-establish refrigeration of the produce during transit is highly desirable.

SUMMARY

Objects and Advantages

The first object of the invention is to provide a modified atmospheric package which allows packaging of produce either in the field or in a centralized plant.

A second object of the invention is to provide a modified atmospheric package which allows refrigeration of the produce after placement in the modified atmospheric packaging.

A third object of the invention is to provide a modified atmospheric package which includes a transparent lid which allows visual observation of the packaged produce at any point following placement in the container to arrival at a final destination.

A fourth object of the invention of the invention is to provide a packaging system which allows iceless broccoli shipments.

A fifth object of the invention is to provide a modified atmospheric package which allows refrigerated air to circulate at least laterally and longitudinally when the modified atmospheric packages are stacked and/or placed in a palletized arrangement.

A sixth object of the invention is to provide a modified atmospheric package which allows detection of tampering, produce decay, produce damage, insect infestation and temperature range excursions.

A seventh object of the invention is to provide a modified atmospheric package which is incorporated into the corrugated fiberboard construction in combination with a transparent lid which facilitates air circulation during packaging and transport.

A eighth object of the invention is to provide a combination modified atmospheric package which is incorporated into a plastic transparent lid and utilizes in combination, a corrugated fiberboard carton having a barrier which facilitates air circulation during packaging and transport.

A ninth object of the invention is to provide a combination modified atmospheric package in which the MAP technology is incorporated into one or more selective permeable membranes in the form of patches. The patches being installed over one or more apertures in either or both the transparent lid and/or standard corrugated fiberboard carton.

A tenth object of the invention is to provide a packaging system which allows direct retail shelf placement and display without requiring removal of the fresh produce.

An eleventh object of the invention is to provide a packaging system which meets or exceeds US Department of Agriculture export requirements for packaging.

This invention addresses the limitations described above and provides a modified atmosphere packaging system and method which allows field harvesting and packaging of produce in either the field or centralized facility, allows cooling ventilation of stacked and/or palletized packages directly in the modified atmosphere packaging, allows visual inspection of the packaged produce at any point following packaging and provides the ability to re-establish refrigeration of the produce during transit is highly desirable.

The ability of modified atmosphere packaging (MAP) to extend the transportation and shelf life has been recognized for many years. MAP is defined as the packaging of perishable produce in an atmosphere, which has been modified so that its composition is other than that of ambient air. The impetus behind the popularity of MAP is based on increased consumer demand for fresh fruits and vegetables and consumer desire for preservative-free products.

As defined herein, the term carton is intended to include a box or tray.

The invention comprises a bulk packaging system which incorporates at least one selective gas permeable membrane. The carton includes an open top, a closed bottom and a plurality of side walls joined to the bottom of the carton. The side walls and the bottom of the carton define an interior storage volume for storing fresh produce. The carton has either a square or rectangular shape and includes a generally air tight barrier such as liner when the selective gas permeable membrane is associated with a lid.

The bulk packaging system further includes a transparent lid of polymeric construction having a length and a width which conforms to a length and a width of the carton and sized to completely cover the open top and at least a portion of an exterior surface of the side walls of the carton.

The lid further includes an interior surface, an exterior surface, four corners, and a plurality of raised stacking support structures disposed at about each of the four corners. The raised stacking support structures includes a predefined height sufficient to provide an air gap between a bottom of another corrugated carton and the exterior surface of the lid when vertically stacked two or more high. In one embodiment of the invention, the predefined height is at least one half centimeter.

The plurality of raised stacking support structures further provides a sealable interior void space contiguous with the interior storage volume which allows accumulation of respiratory gases generated by the packaged produce and/or maintains a cover gas within the interior storage volume.

The transparent lid further includes a rim which circumnavigates an entire perimeter of the lid and extends vertically downward along the exterior of the plurality of side walls such that the lid fully encloses the open top and the rim fully encloses any void spaces along the exterior side walls which would allow ambient air to come directly in contact with the stored produce contained therein.

The lid may further include one or more selliform contours to conform with one or more downward facing concavities included in each of the plurality of side walls.

The lid is sealingly attached to the carton using sealing attachment means such that the at least one selective gas permeable membrane maintains a modified atmosphere within the interior storage volume.

The lid may further include an anti-fogging treatment to limit moisture from condensing on the interior surface.

The at least one selective gas permeable membrane may be incorporated into the polymeric construction of the lid, the fiberboard construction of the carton or a combination thereof.

In another embodiment of the invention one or more apertures are included in the lid, the carton or a combination thereof and the at least one selective gas permeable membrane is in the form of an adhesive patch, having dimensions greater than the one or more apertures, is placed over the aperture(s), thus preventing ambient air to come directly in contact with the stored produce contained therein.

The bulk packaging system incorporating at least one selective gas permeable membrane may be implemented by accomplishment of the following steps:

a. harvesting a fresh produce at a field location, b. placing the fresh produce into a corrugated carton at either the field location or a centralized facility, c. refrigerating the fresh produce, d. applying a cover gas if necessary to the fresh produce, and e. using sealing attachment means, sealingly attaching a transparent lid to the corrugated carton.

In addition to the above listed steps, in the embodiment of the invention where one or more apertures are provided, applying the at least one selective gas permeable membrane to at least one aperture associated with either the transparent lid or the corrugated carton.

In addition to the above listed steps, performing the prerequisite step of selecting an appropriate of the at least one selective gas permeable membrane suitable for use with the fresh produce.

In addition to the above listed steps, applying a temperature excursion and/or oxygen sensor(s) to the transparent lid.

In addition to the above listed steps, applying a tamper detection seal to an interface where the transparent lid and the corrugated carton are joined together by the sealing attachment means.

BRIEF DESCRIPTION OF DRAWINGS

The features and advantages of the invention will become apparent from the following detailed description when considered in conjunction with the accompanying drawings. Where possible, the same reference numerals and characters are used to denote like features, elements, components or portions of the invention. It is intended that changes and modifications can be made to the described embodiment without departing from the true scope and spirit of the subject invention as defined in the claims.

DETAILED DESCRIPTION

Figure 1:
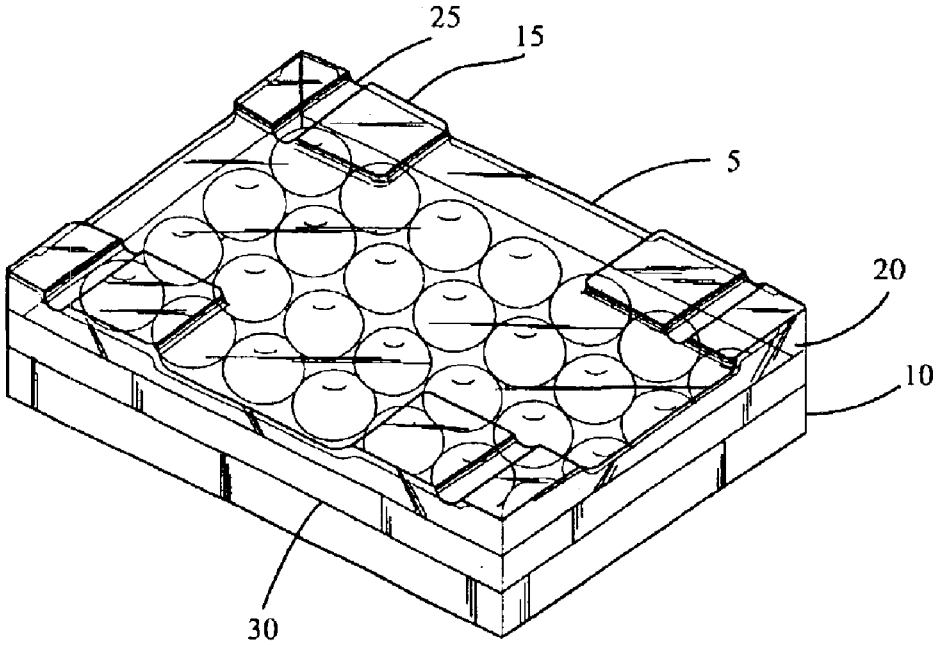
FIG. 1—FIG. 1 depicts a perspective view of a basic embodiment of the invention.

Referring to FIG. 1, a perspective view of a basic embodiment of the invention is shown where a corrugated carton 10 and a transparent lid 5 are used to maintain a modified atmosphere for delayed ripening of the produce contained therein. The lid 5 is sealingly attached to the carton 10 using sealing packing tape 30. Alternate sealing attachment means for attaching the lid 5 to the carton 10 includes the use of hot glue or a elastic gasket placed between the inner surface of a rim 20 associated with the lid 5 and the exterior surface of the side walls of the carton 10.

The lid 5 includes a plurality of generally rectangular or triangular, raised stacking structures 15 disposed at about each of the four corners of the lid 5. In one embodiment of the invention, each of the raised stacking structures 15 includes a horizontal groove 25 running longitudinally through each raised stacking structure 15. The grooves 25 are laterally offset from a lateral centerline of the raised stacking structure 15 such that each groove 15 is disposed closer to a nearest lateral edge of the lid 5.

Each groove is uniformly aligned on a longitudinal axis of a lid such that longitudinally adjacent grooves are disposed about the same distance from the nearest lateral edge of the lid 5. The height of each of the raised stacking structures 15 is at least 0.5 cm above an average horizontal surface of the lid 5, generally in a range of 0.5 cm to 5 cm. The height of the raised stacking structures 15 provides an air gap between a bottom of another carton which allows cooling air to flow both laterally and longitudinally across an exterior surface of the lid 5 and the bottom of another carton when vertically stacked two or more high and/or when uniformly placed in multiple columns and rows on a pallet.

Likewise, the grooves 25 included in each of the raised stacking structures 15 allows cooling airflow to penetrate between opposing stacking structures. An underside of each raised stacking structure 15 forms a sealed depression in the lid 5 which provides a headspace internal to the carton for accumulating respiratory gases generated by the produce and may also be used to maintain a reservoir of cover gas if required for maintaining a particular type of produce.

In an alternate embodiment of the invention, the lid 5 includes a selliform depression between both adjacent lateral and longitudinal raised stacking structures 15 such that an underside of the lid 5 conforms to the top vertical edges of a Bliss or other style carton commonly used to package fresh produce.

The lid 5 is constructed of a semi rigid to rigid polymeric material such as polyvinyl chloride, polypropylene or polyethylene and is sized to fit over the corrugated carton and conform to the vertical edges of the side walls. The lid 5 includes a rim 20 that extends downward sufficiently to cover downward facing concavities incorporated into the vertical sidewalls of the carton common to Bliss or other style packaging. For example, the carton shown in U.S. Pat. No. 5,052,615 to Ott, et al.

The thickness of the lid 5 may be varied to obtain the desired structural strength for stacking and having a general range of 0.25 mm to about 2.0 mm. The inner surface of the lid may be treated with an anti-fog coating or film to limit condensation from developing on the interior surface which would limit the ability to observe the contents of the carton.

The carton 10 is constructed of corrugated fiberboard and may include a selective permeable membrane or active oxygen scavenging polymer incorporated into its construction. The carton 10 includes four vertical side walls perpendicularly joined to a fiberboard bottom forming a regular polygon in the shape of either a square or rectangular box.

The carton is intended to have a standard footprint (dimensions) of 40 cm×60 cm but other dimensions such as 40 cm×30 cm are envisioned as well. The top of the carton is open, allowing unrestricted access to an interior storage volume defined by the vertical sidewalls and bottom. The vertical height of the sidewalls is variable, typically in the range of 10 cm–30 cm, and largely dependent on the desired packing density of the produce to be placed within the carton. In general, the produce should be placed so as to reach a height equal to or below that of the lowest open top edge of the vertical sidewalls. The permeability of the selective membrane is chosen based on the respiratory nature of the produce to be contained within the packaging. A type of corrugated fiberboard construction suitable for use in this invention is described in U.S. Pat. No. 5,575,418 to Wu, et al. and herein incorporated by reference. Other polymeric films suitable for use are commercially available from numerous suppliers. For example, Cryovac Division of W.R. Grace & Company, Duncan, S.C. www.cryovac.com (See PD 900 family of films.)

Figure 2:
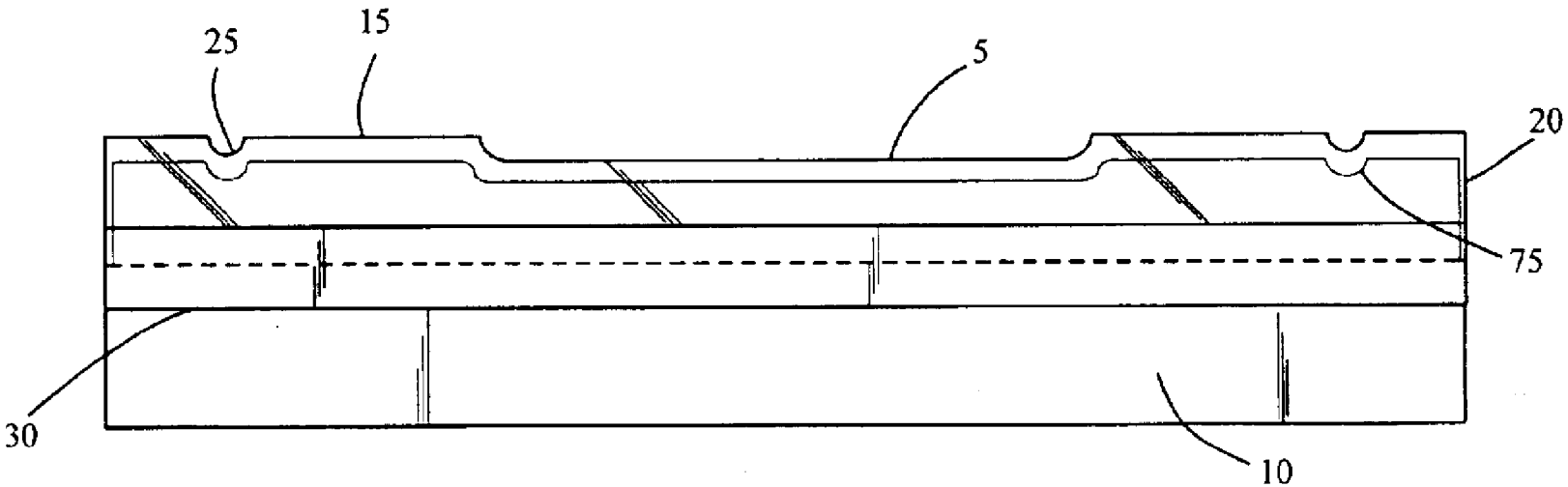
FIG. 2—FIG. 2 depicts a side view of the basic embodiment invention.

Referring to FIG. 2, a side view of a long dimension of the modified atmosphere packaging system is shown where the lid 5 includes a selliform profile to conform to the vertical top edges of the carton 10. The downward facing edge 20 of the lid 5 is sealingly attached to the carton 10 using sealing packing tape 30. The raised stacking structures 15 are shown with a generally planar exterior surface which is substantially parallel to the exterior surface of the lid 5. The grooves 25 are intended to mate with grooves 75 included in the carton 10 which allows the lid to 5 to lie flush with the vertical edges of the carton. The dashed line indicates the end of the downward facing rim 20 which is covered by the sealing tape 30. The downward facing rim 20 extends vertically downward along the exterior surface of the four vertical sidewalls sufficiently to fully enclose any exposed concavities associated with the vertical sidewalls and allow adequate contact surfaces for application of the packing tape at an interface where the end of the rim and exposed portion of the vertical sidewalls of the carton occur. The sealing tape 30 may be used as a product tampering indicator or another seal may be placed over the tape 30.

Figure 3A:
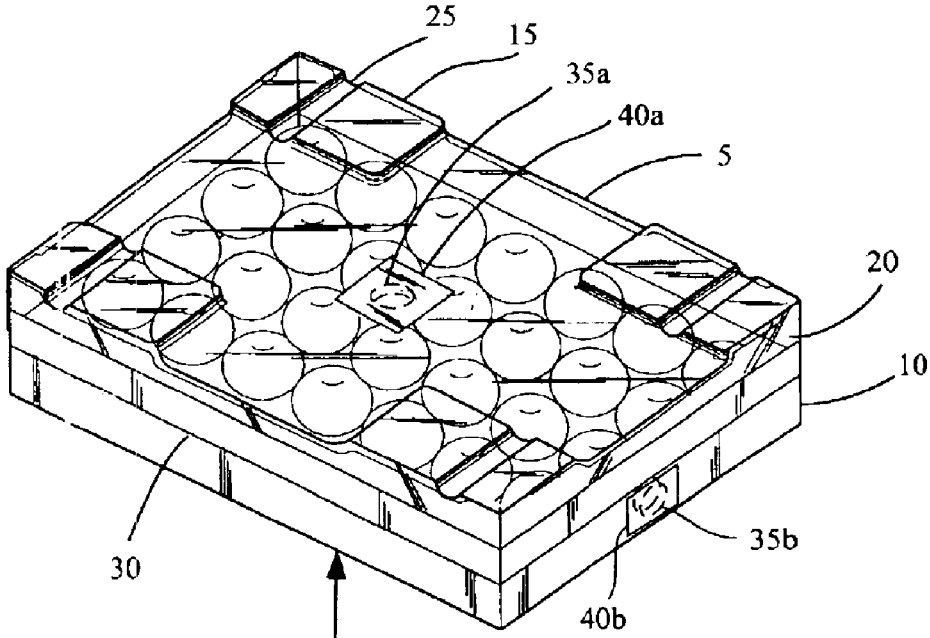
FIG. 3A—FIG. 3A depicts a perspective view of an alternate embodiment of the invention.
Figure 3B:
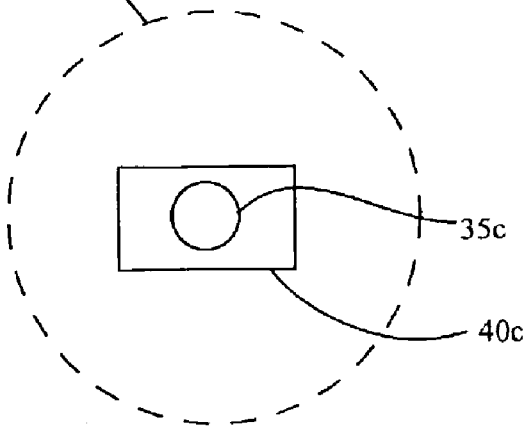
FIG. 3B—FIG. 3B depicts a perspective view of another alternate embodiment of the invention.

Referring to FIGS. 3A and 3B, an alternate embodiment of the invention is shown where one or more apertures 35*a*, 35*b*, 35*c* are provided in one or more surfaces such as the lid, one or more vertical sidewalls or the bottom of the carton. The apertures fully penetrate the lid, sidewalls and/or bottom of the carton such that external ambient air is in contiguous contact with the interior storage volume of the carton. One or more selective permeable membranes in the form of adhesive patches 40*a*, 40*b* are applied over the apertures and adhered to the lid 5 and/or vertical sidewall of the carton 10 to establish a modified atmosphere within the interior storage volume of the carton. The adhesive patches 40*a*, 40*b*, 40*c* are sized to fully enclose and seal the apertures.

The adhesive patches 40*a*, 40*b*, 40*c* suitable for use with this invention are available from a number of suppliers including Landec Corporation, 3603 Haven Avenue, Menlo Park, Calif. www.Landec.com (See Intellipac™ smart labels,) River Ranch Technology, Incorporated, 1156 Abbott Street, Salinas, Calif., www.riverranchfreshfoods.com/FreshHold/freshhold.html.

In this embodiment of the invention, the lid 5 and carton 10 do not include modified atmosphere packaging technology but otherwise will retain a modified atmosphere established using the adhesive packages. The carton 10 used in this embodiment of the invention will need to be sealed and generally airtight to prevent loss of the modified atmosphere. The lid 5 is sealingly attached to the carton 10 using the sealing tape 30 or alternate sealing attachment means described above.

Figure 4:
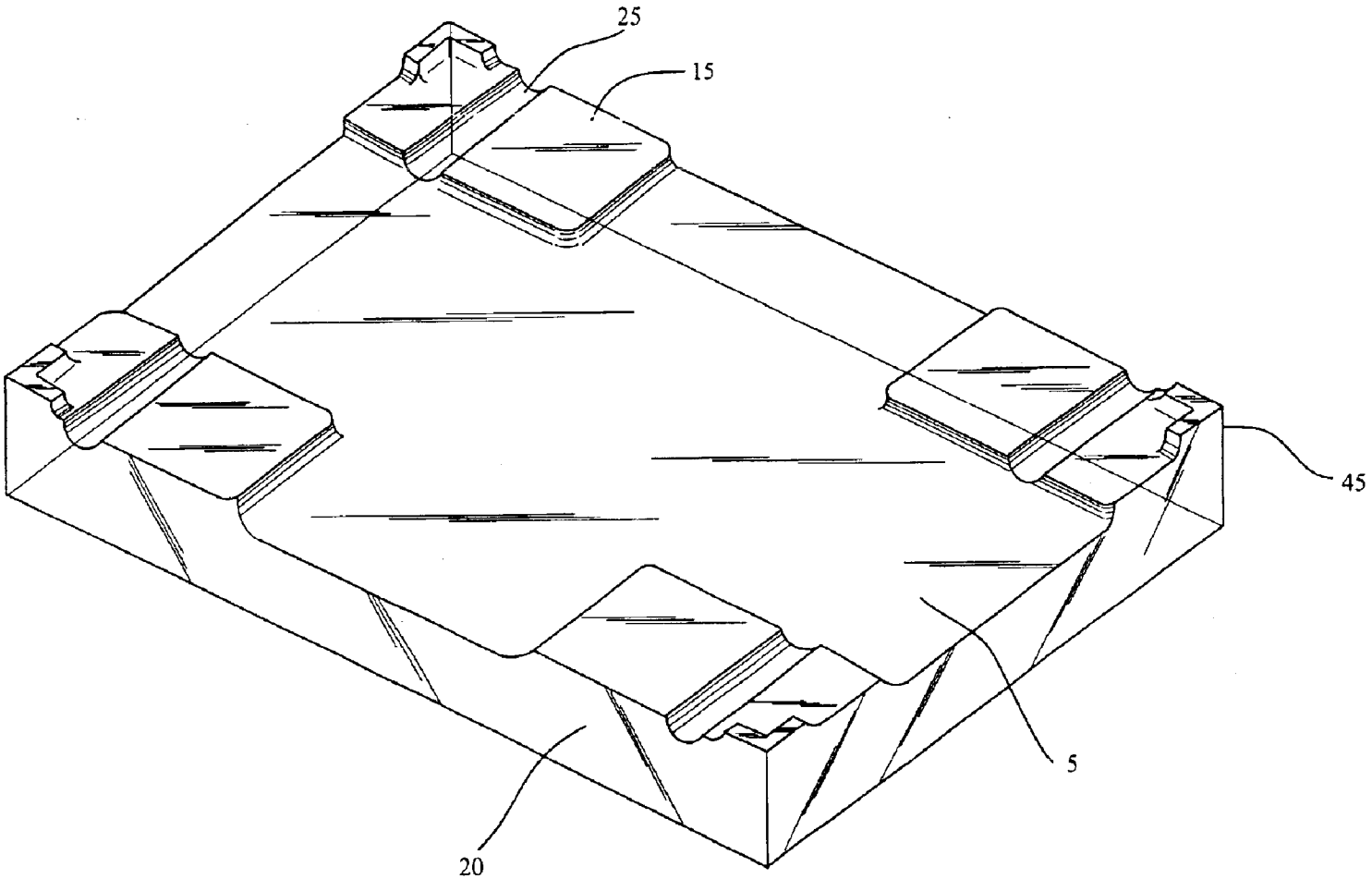
FIG. 4—FIG. 4 depicts a perspective view of another alternate embodiment of the invention.

Referring to FIG. 4, an alternate embodiment of a lid 5 which may be used in the modified atmosphere packaging system is shown. The lid 5 is essentially the same as that shown in FIG. 1, with the addition of vertical stacking tabs 45 disposed at each of the four corners of the lid 5.

The vertical stacking tabs 45 allow the modified atmosphere packaging system to vertically stack with returnable plastic crates (RPC's) which are occasionally used to transport fresh produce to market. Each of the vertical stacking tabs 40 includes a right angle matching each corner of the lid. The right angle portion of each of the vertical stacking tabs 40 have a height sufficient to engage a lower side of adjacent to a bottom corner of an returnable plastic crate, generally in the range of 0.5 cm to 5 cm. The bottom corners of the returnable plastic crate is supported by the four raised stacking structures 15.

Figure 5:
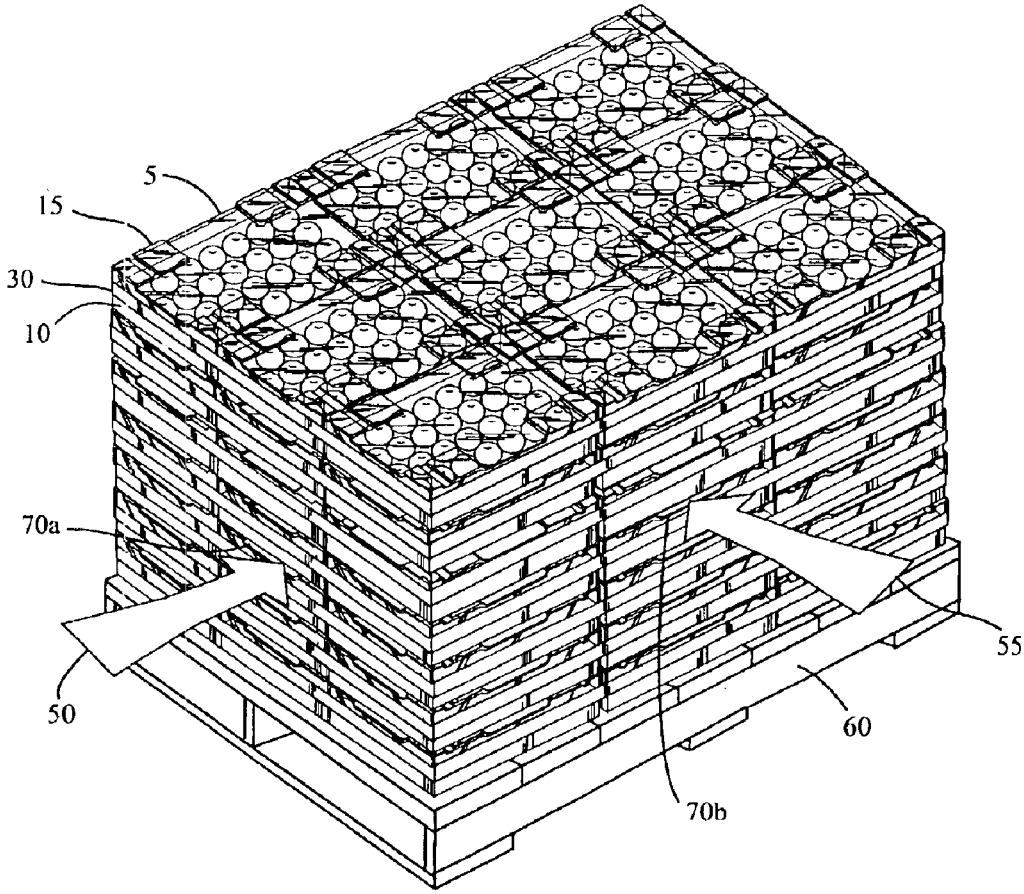
FIG. 5—FIG. 5 depicts a perspective view of the basic embodiment of the invention shown in a palletized arrangement.

Referring to FIG. 5, a perspective view of the modified atmosphere packaging system is shown where a plurality of packages are palletized and stacked in rows and columns. The raised supporting structures 25 allow refrigerated air to flow laterally 50 and longitudinally 55 through a plurality of air gaps 70*a*, 70*b* created between a bottom of a carton vertically and uniformly stacked and supported by a raised stacking structure 15 on an underlying lid 5 and carton 10 combination. This arrangement allows more efficient re-refrigeration of the interior packages placed on the pallet. The transparent lid 5 allows visual inspection of the produce for detection of insects, mold, decay or contraband without having to unseal the packages.

The modified atmosphere packaging system may be deployed for field harvesting of fresh produce or used at a central packing facility. In order to obtain satisfactory results, the proper selective gas permeable membrane packaging suitable for use with the intended fresh produce to packaged must be selected. Once the proper packaging is selected, the fresh produce is placed inside the cartons. The cartons containing the produce should then be refrigerated.

Following refrigeration, the lids should be placed on the cartons containing the fresh produce, and if advantageous for the particular type of produce, a cover gas such as nitrogen or carbon dioxide may added by lifting the lids slightly to allow a cover gas discharge nozzle to enter the interior storage volume of the carton and discharging the cover gas, followed immediately by sealingly attaching a transparent lid to said corrugated carton. Alternately, the lid may be sealingly attached to the carton and the gas injected and the injection hole plugged as described in U.S. Pat. No. 5,575,418 to Wu, et al. If no cover gas is to be supplied, the lids should be sealingly attached to the cartons immediately following refrigeration.

In an alternate embodiment of the invention, where one or more apertures are provided on either the lids and/or cartons, the lid may be attached to the carton before applying the cover gas. The discharge nozzle of the cover gas may be placed into the aperture and allowed to discharge the cover gas followed immediately by applying one or more selective gas permeable membranes to the a apertures associated with either the transparent lid or corrugated carton.

In either embodiment of the invention, temperature excursion sensors, oxygen sensors, and/or tamper detection seals may be applied to the packaging.

The foregoing described embodiments of the invention are provided as illustrations and descriptions. They are not intended to limit the invention to precise form described. In particular, it is contemplated that functional implementation of the invention described herein may be constructed of varying materials and different packaging arrangements. Other variations and embodiments are possible in light of above teachings, and it is not intended that this Detailed Description limit the scope of invention, but rather by the Claims following herein.

We claim:

1. A bulk packaging system which incorporates at least one selective gas permeable membrane comprising:

a corrugated carton of fiberboard construction having a regular polygon shape including;

an open top, a closed bottom, and a plurality of side walls joined to said bottom, wherein said side walls and said bottom defines therein a sealable interior storage volume;

a transparent lid of polymeric construction having;

a shape conforming to said regular polygon shape of said corrugated carton and sized to completely cover said open top and at least an exterior portion of each of said side walls of said carton, an interior surface, an exterior surface, four corners, and a plurality of raised stacking support structures disposed at about each of said four corners wherein each of said raised stacking support structures includes;

a predefined height which defines an air gap between a bottom of another corrugated carton and said exterior surface of said lid when vertically stacked two or more high; and at least one selective gas permeable membrane in communication with said interior storage volume and an ambient atmosphere.

2. The system according to 1 wherein said at least one selective gas permeable membrane is incorporated into said corrugated fiberboard construction.

3. The system according to 1 wherein said at least one selective gas permeable membrane is incorporated into said transparent lid polymeric construction.

4. The system according to 1 wherein either said transparent lid or said corrugated carton further includes at least one aperture contiguous with said interior storage volume and said ambient atmosphere.

5. The system according to 4 wherein said at least one selective gas permeable membrane is incorporated into at least one separate adhesive patch having an area greater than that of said at least one aperture and applied over said at least one aperture such that said at least one aperture is completely covered by said at least one separate adhesive patch.

6. The system according to 1 wherein each of said plurality of raised stacking support structures further includes an interior void space contiguous with said interior storage volume.

7. The system according to 6 wherein each of said interior void spaces provides a headspace to allow expansion of one or more gases present within said interior storage volume.

8. The system according to 1 wherein said predefined height is sufficient to allow cooling ventilation to flow through said air gap in either a lateral or longitudinal direction when vertically stacked two or more high.

9. The system according to 8 wherein a plurality of said corrugated cartons and associated transparent lids may be placed uniformly on a transportation pallet without significant obstruction of said cooling ventilation.

10. The system according to 1 further including means for supplying a cover gas to fill at least said interior storage volume.

11. The system according to claim 1 further including sealing attachment means for sealingly attaching said transparent lid to said corrugated carton such that said at least one selective gas permeable membrane maintains a modified atmosphere within said interior storage volume.

12. The system according to claim 1 wherein said transparent lid further includes a rim which circumnavigates an entire perimeter of said lid and extends vertically downward along an exterior surface of each of said plurality of side walls such that said lid fully encloses said open top and said rim fully encloses any downward facing concavities included in said plurality of side walls.

13. The system according to claim 1 wherein said transparent lid further includes an anti-fogging treatment.

14. The system according to claim 1 wherein said regular polygon shape includes a square or a rectangle.

15. The system according to claim 1 wherein said corrugated carton further includes a generally air tight liner when said at least one, selective gas permeable membrane is associated with said lid.

16. A bulk packaging system which incorporates at least one selective gas permeable membrane comprising:

a corrugated carton of fiberboard construction having a rectangular shape including;

an open top, a closed bottom, and a plurality of side walls joined to said bottom, wherein said side walls and said bottom defines therein a sealable interior storage volume;

a transparent lid of polymeric construction having;

a shape conforming to said regular rectangular shape of said corrugated carton and sized to completely cover said open top and said side walls of said carton, an interior surface, an exterior surface, four corners, and a plurality of raised stacking support structures disposed at about each of said four corners wherein each of said raised stacking support structures includes;

a predefined height sufficient to provide an air gap between a bottom of another corrugated carton, and at least one aperture contiguous with said interior storage volume and an ambient atmosphere.

17. The system according to claim 16 further including means for sealingly attaching said transparent lid to said corrugated carton such that said at least one selective gas permeable membrane maintains a modified atmosphere within said interior storage volume.

18. The system according to claim 16 wherein said predefined height is at least one half centimeter.

19. The system according to claim 16 wherein each of said plurality of raised stacking support structures further includes an interior void space contiguous with said interior storage volume.

20. The system according to claim 16 wherein said at least one selective gas permeable membrane is incorporated into at least one separate adhesive patch having an area greater than that of said at least one aperture and applied over said at least one aperture such that said at least one aperture is completely covered by said at least one separate adhesive patch.

21. The system according to claim 16 wherein said transparent lid further includes a rim which circumnavigates an entire perimeter of said lid and extends vertically downward along an exterior surface of each of said plurality of side walls such that said lid fully encloses said open top and said rim fully encloses any downward facing concavities included in said plurality of side walls.

22. The system according to claim 16 wherein said corrugated carton further includes a generally air tight liner when said at least one selective gas permeable membrane is associated with said lid.

23. A bulk packaging system which incorporates at least one selective gas permeable membrane comprising:

a corrugated carton of fiberboard construction having a rectangular shape including;

an open top, a closed bottom, and a plurality of side walls joined to said bottom, wherein said side walls and said bottom defines therein a sealable interior storage volume, and a gas permeable membrane combined with said fiberboard construction; and a transparent lid of polymeric construction having;

a shape conforming to said regular rectangular shape of said corrugated carton and sized to completely cover said open top and said side walls of said carton, an interior surface, an exterior surface, four corners, and a plurality of raised stacking support structures disposed at about each of said four corners wherein each of said raised stacking support structures includes;

a predefined height sufficient to provide an air gap between a bottom of another corrugated carton and said exterior surface when vertically stacked two or more high.

24. The system according to claim 23 wherein said predefined height is at least one half centimeter.

25. The system according to claim 23 wherein each of said plurality of raised stacking support structures further includes an interior void space contiguous with said interior storage volume.

26. The system according to claim 23 wherein said transparent lid further includes a rim which circumnavigates an entire perimeter of said lid and extends vertically downward along an exterior surface of each of said plurality of side walls such that said lid fully encloses said open top and said rim fully encloses any downward facing concavities included in said plurality of side walls.

27. The system according to claim 23 further including means for sealingly attaching said transparent lid to said corrugated carton such that said at least one selective gas permeable membrane maintains a modified atmosphere within said interior storage volume.

* * * * *

UNITED STATES PATENT AND TRADEMARK OFFICE

CERTIFICATE OF CORRECTION

PATENT NO. : 6,880,748 B2
APPLICATION NO. : 10/397945
DATED : April 19, 2005
INVENTOR(S) : Machado It is certified that error appears in the above-identified patent and that said Letters Patent is hereby corrected as shown below:

Title Page, Item (12) delete "Machado et al" and insert --Machado--.

Title Page, Item (75) Inventors, should read

--(75) Inventor: Craig Dale Machado, Arroyo Grande, CA (US)--.

Signed and Sealed this
Fifteenth Day of March, 2016

Michelle K. Lee

Michelle K. Lee
*Director of the United States Patent and Trademark Office*